US008796618B2

(12) United States Patent
Kim et al.

(10) Patent No.: US 8,796,618 B2
(45) Date of Patent: Aug. 5, 2014

(54) APPARATUS AND METHOD FOR CONTROLLING A PIPELINE-TYPE ION CYCLOTRON RESONANCE MASS SPECTROMETER

(75) Inventors: Seung Yong Kim, Daejeon (KR); Hyun Sik Kim, Daejeon (KR); Jong Shin Yoo, Seoul (KR)

(73) Assignee: Korea Basic Science Institute, Daejeon (KR)

( * ) Notice: Subject to any disclaimer, the term of this patent is extended or adjusted under 35 U.S.C. 154(b) by 0 days.

(21) Appl. No.: 13/511,157

(22) PCT Filed: Nov. 16, 2010

(86) PCT No.: PCT/KR2010/008079
§ 371 (c)(1),
(2), (4) Date: May 22, 2012

(87) PCT Pub. No.: WO2011/081298
PCT Pub. Date: Jul. 7, 2011

(65) Prior Publication Data

US 2012/0267524 A1 Oct. 25, 2012

(30) Foreign Application Priority Data

Dec. 29, 2009 (KR) ..... 10-2009-0132789

(51) Int. Cl.
*H01J 49/38* (2006.01)
*H01J 49/02* (2006.01)

(52) U.S. Cl.
CPC ..... *H01J 49/38* (2013.01); *H01J 49/022* (2013.01)
USPC ..... 250/291; 250/281; 250/282

(58) Field of Classification Search
CPC ..... H01J 49/38
USPC ..... 250/291
See application file for complete search history.

(56) References Cited

U.S. PATENT DOCUMENTS

| | | | | |
|---|---|---|---|---|
| 4,945,234 | A * | 7/1990 | Goodman et al. | 250/291 |
| 6,573,495 | B2 * | 6/2003 | Senko | 250/290 |
| 6,974,702 | B2 * | 12/2005 | Dasseux et al. | 436/86 |
| 7,045,779 | B2 * | 5/2006 | Davis | 250/291 |

(Continued)

FOREIGN PATENT DOCUMENTS

| | | |
|---|---|---|
| JP | 2002-033072 A | 1/2002 |
| JP | 2008-052996 A | 3/2008 |

(Continued)

*Primary Examiner* — Nicole Ippolito
*Assistant Examiner* — James Choi
(74) *Attorney, Agent, or Firm* — Rabin & Berdo P.C.

(57) ABSTRACT

The present invention relates to an apparatus and method for controlling a pipeline-type ion cyclotron resonance mass spectrometer, in which an ion trap unit of the ion cyclotron resonance mass spectrometer is capable of using two digitizers at the same time, thus enabling a measurement process for detecting an electrical signal which indicates the mass of ions corresponding to a specific purpose, and another measurement process for detecting another electrical signal which indicates the mass of ions corresponding to another specific purpose, to be simultaneously performed. Accordingly, it is an aim of the present invention to provide an apparatus and method for controlling a pipeline-type ion cyclotron resonance mass spectrometer, which can overcome the problems of time delay among control procedures, and can present a signal detection step wherein an excitation electrode is utilized to improve the sensitivity and speed of signal detection.

1 Claim, 6 Drawing Sheets

(56) References Cited

U.S. PATENT DOCUMENTS

| | | | | |
|---|---|---|---|---|
| 7,292,030 | B2 * | 11/2007 | Laubacher | 324/300 |
| 7,495,211 | B2 * | 2/2009 | Franzen et al. | 250/291 |
| 7,655,903 | B2 * | 2/2010 | Zubarev et al. | 250/291 |
| 2006/0027743 | A1 * | 2/2006 | Franzen et al. | 250/286 |
| 2006/0226357 | A1 * | 10/2006 | Franzen et al. | 250/307 |
| 2008/0099672 | A1 * | 5/2008 | Kim et al. | 250/291 |
| 2009/0008549 | A1 * | 1/2009 | Kim et al. | 250/291 |
| 2009/0166533 | A1 * | 7/2009 | Choi et al. | 250/291 |
| 2013/0112864 | A1 * | 5/2013 | Kim et al. | 250/282 |

FOREIGN PATENT DOCUMENTS

| | | | |
|---|---|---|---|
| KR | 10-0659263 | B1 | 12/2006 |
| KR | 10-2009-0073521 | A | 7/2009 |
| WO | WO 2006045393 | A2 * | 5/2006 |

* cited by examiner

APPARATUS AND METHOD FOR CONTROLLING A PIPELINE-TYPE ION CYCLOTRON RESONANCE MASS SPECTROMETER

TECHNICAL FIELD

The present invention relates to an ion cyclotron resonance mass spectrometer control system, and more particularly, to an apparatus and method for controlling a pipeline-type ion cyclotron resonance mass spectrometer capable of simultaneously using two digitizers in an ion trap unit of an ion cyclotron resonance mass spectrometer.

BACKGROUND ART

A control apparatus of a general ion cyclotron resonance mass spectrometer will be described with reference to FIGS. 1 to 4 as follows:

FIG. 1 is a schematic view of the control apparatus of the general ion cyclotron resonance mass spectrometer, FIG. 2 is a circuit diagram showing signal transmission to an ion trap, FIG. 3 shows a sequence of controlling respective blocks in a control program according to a related art, and FIGS. 4*a* and 4*b* are views for explaining a way to use hardware resources through a pipeline control method according to a related art.

As shown in FIG. 1, the general ion cyclotron resonance mass spectrometer includes a sample injection/ionization unit 1 configured to ionize an injected sample and discharge ionized samples, a first ion transmission unit 2 configured to transmit the ions discharged from the sample injection/ionization unit 1, an ion selection (separation) unit 3 configured to select or separate and discharge the ions transmitted through the first ion transmission unit 2 according to a specific purpose, an ion collision unit 4 configured to collide the ions selected or separated by the ion selection (separation) unit 3 with a collision gas to divide the ions into smaller sizes of ions and then discharge the ions, a second ion transmission unit 5 configured to transmit the ions divided by the ion collision unit 4, an ion trap 6 configured to collect the ions transmitted through the second ion transmission unit 5 into the ion trap and then detect an electrical signal representing the mass of the ions satisfying a specific purpose, an arbitrary waveform generating unit (AWG) 8 configured to generate an arbitrary waveform from the signal detected by the ion trap 6 using a control program of a computer 10, and a high frequency amplifier (RF Amp) 7 configured to amplify the generated arbitrary waveform, wherein the amplified waveform is applied to the ion trap 6 to excite the ions. The excited signal passes through a pre-amplifier (Pre Amp) 12 shown in FIG. 2 via another electrode to be amplified to a signal size appropriate for detection, and then, passes through a digitizer (A/D) 13 to become a digital signal, so that signal processing is performed in the computer.

FIG. 3 shows a case in which hardware resources are sequentially used according to a time flow.

FIGS. 4*a* and 4*b* show a way to use the hardware resources through a pipeline control method according to a related art.

While pipeline-type parallel control procedures may be configured as shown in FIG. 4A, when various procedures overlap in the same time band in an actual time region as shown in FIG. 4B, the procedure having the longest control time causes a time delay of the other control procedures. The time delay occurred when the control procedures overlap, causes loss of control time and sample processing, reducing precision and efficiency of experiments.

DISCLOSURE

Technical Problem

In order to solve the foregoing and/or other problems, it is an object of the present invention to provide a pipeline-type ion cyclotron resonance mass spectrometer control method capable of simultaneously using two digitizers in an ion trap unit of an ion cyclotron resonance mass spectrometer, and repeatedly performing another measurement process of detecting an electrical signal representing the mass of ions satisfying a specific purpose during one measurement process of detecting an electrical signal representing the mass of ions satisfying a specific purpose, and thus, provide an to apparatus and method for controlling a pipeline-type ion cyclotron resonance mass spectrometer capable of solving the time delay between control procedures, and proposing a signal detection step having higher sensitivity and speed using an excitation electrode in the signal detection step.

Technical Solution

The foregoing and/or other aspects of the present invention may be achieved by providing an apparatus for controlling a pipeline-type ion cyclotron resonance mass spectrometer including an ion trap 6 configured to collect ions transmitted through an ion transmission tube and detect an electrical signal representing the mass, an arbitrary waveform generating unit 8 configured to generate an arbitrary waveform by a computer 10, and a high frequency amplification unit 7 configured to high frequency-amplify the arbitrary waveform of the arbitrary waveform generating unit 8, wherein the signal amplified by the high frequency amplification unit 7 is applied to an excitation electrode of the ion trap 6, and the electrical signal of the mass of the ions detected by the ion trap 6 is amplified through a first pre-amplifier 12 to be converted into a digital signal through a first digitizer 13 to be transmitted to the computer 10, characterized in that the apparatus includes: a switching unit 21 configured to switch a high frequency amplification signal of the high frequency amplification unit 7 to have directionality to apply the signal to the excitation electrode of the ion trap 6; a second pre-amplifier 22 configured to pre-amplify the ion trap signal applied through the switching unit 21 and detected by the electrode of the ion trap 6; a second digitizer 23 configured to digitalize the signal amplified through the second pre-amplifier 22 to transmit the signal to the computer 10; and a control unit 11 configured to ionize an injected sample, apply the ions to the ion trap 6 through the ion transmission tube, and control switching the switching unit 21.

Here, the switching unit 21 may be configured such that, when a high frequency signal amplified by the high frequency amplification unit 7 is input, the high frequency signal is applied to the excitation electrode of the ion trap 6, and when the high frequency amplification unit 7 is OFF, signal direction of the switching unit 21 is changed so that a signal detected by ion movement in the ion trap 6 is controlled to flow to the second pre-amplifier 22.

The control unit 11 may perform functions of operating a sample injection/ionization unit 1 to ionize and discharge an injected sample, continuously operating a first ion transmission unit 2 to transmit the ions discharged from the sample injection/ionization unit 1, continuously operating an ion selection (separation) unit 3 to select or separate and discharge the transmitted ions according to a specific purpose, continuously operating an ion collision unit 4 to collide the ions selected or separated by the ion selection (separation) unit 3 with a collision gas to divide the ions into smaller sizes and discharge the divided ions, continuously operating a second ion transmission unit 5 to transmit the collided ions, continuously operating the ion trap unit 6 to collect the transmitted collided ions into the ion trap and then detect an electrical signal representing the mass of ions satisfying a specific purpose, transmitting the electrical signal detected by the ion trap unit 6 to the computer 10 equipped with a mass measurement and analysis program, and sequentially controlling the respective units to a repeat number N determined for the experiment.

Other aspects of the present invention may be achieved by providing a method of controlling a pipeline-type ion cyclotron resonance mass spectrometer including an ion trap 6 configured to ionize an ion sample injected through a sample injection/ionization unit 1 and collect ions transmitted through an ion transmission tube to detect an electrical signal representing the mass, an arbitrary waveform generating unit 8 configured to generate an arbitrary waveform by a computer 10, and a high frequency amplification unit 7 configured to high frequency-amplify the arbitrary waveform of the arbitrary waveform generating unit 8, wherein the signal amplified by the high frequency amplification unit 7 is applied to an excitation electrode of the ion trap 6, and the electrical signal of the mass of the ions detected by the ion trap 6 is amplified through a first pre-amplifier 12 to be converted into a digital signal through a first digitizer 13 to be transmitted to the computer 10, characterized in that the method includes: operating the sample injection/ionization unit 1 to ionize and discharge the injected sample; continuously operating a first ion transmission unit 2 to transmit the ions discharged from the sample injection/ionization unit 1; continuously operating an ion selection (separation) unit 3 to select or separate and discharge the transmitted ions according to a specific purpose; continuously operating an ion collision unit 4 to collide the ions selected or separated by the ion selection (separation) unit 3 with a collision gas to divide the ions into smaller sizes to discharge the divided ions; continuously operating a second ion transmission unit 5 to transmit the collided ions; continuously operating the ion trap 6 to collect the transmitted collided ions in the ion trap, and then, detect an electrical signal representing the mass of the ions; and transmitting the electrical signal detected by the ion trap 6 to the computer 10 equipped with a mass measurement and analysis program, and then, sequentially controlling the respective units to a repeat number N determined for an experiment.

Advantageous Effects

In the apparatus and method for controlling a pipeline-type ion cyclotron resonance mass spectrometer in accordance with the present invention, before completion of a process of detecting an electrical signal representing mass of ions satisfying a specific purpose in a trap during each sequential control of hardware resources of the ion cyclotron resonance mass spectrometer, since the other hardware resources such as a sample injection/ionization unit, a first ion transmission unit, an ion selection (separation) unit, an ion collision unit, and a second ion transmission unit are independently operated to detect an electrical signal representing the mass of ions satisfying another specific purpose, the rate of operation of the hardware resources with respect to the ion cyclotron resonance mass spectrometer can be improved in comparison with the related art, and particularly, measurement time consumed to sequentially control respective parts to a repeat number N determined for an experiment can be reduced by at least half the time.

DESCRIPTION OF DRAWINGS

The above and other aspects and advantages of the present invention will become apparent and more readily appreciated from the following description of exemplary embodiments, taken in conjunction with the accompanying drawings of which.

MODE FOR INVENTION

Figure 1:
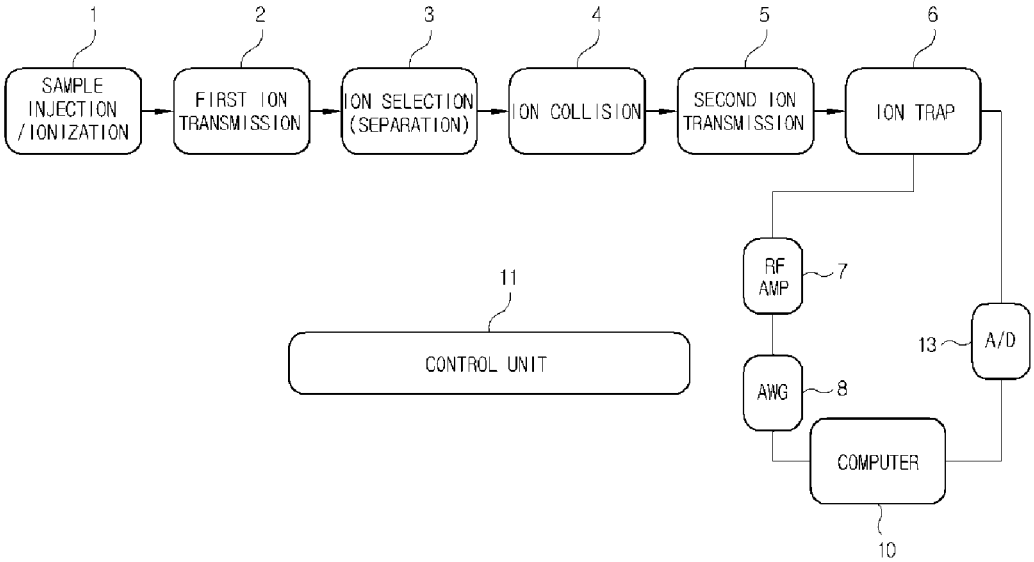
FIG. 1 is a schematic view of a control apparatus of a general ion cyclotron resonance mass spectrometer.
Figure 2:
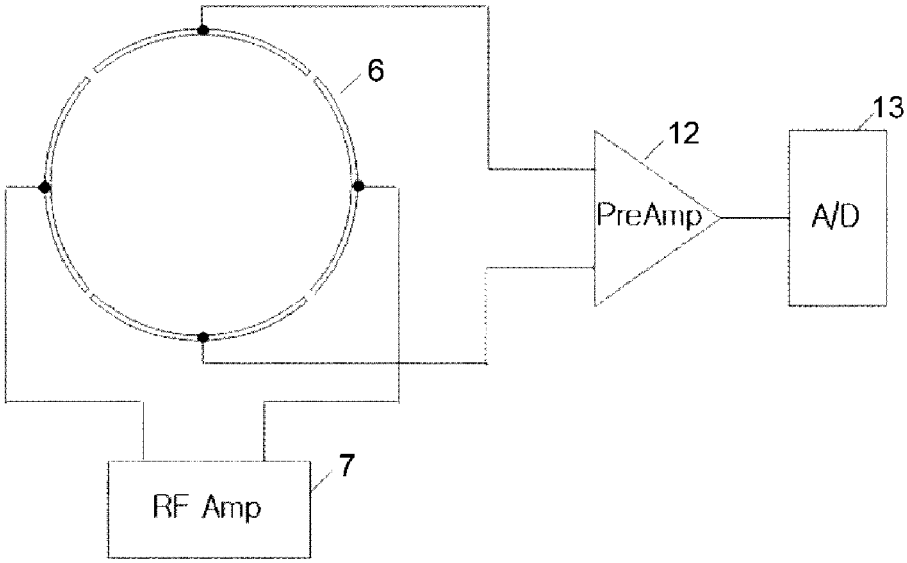
FIG. 2 is a circuit diagram showing signal transmission to an ion trap according to a related art.
Figure 3:
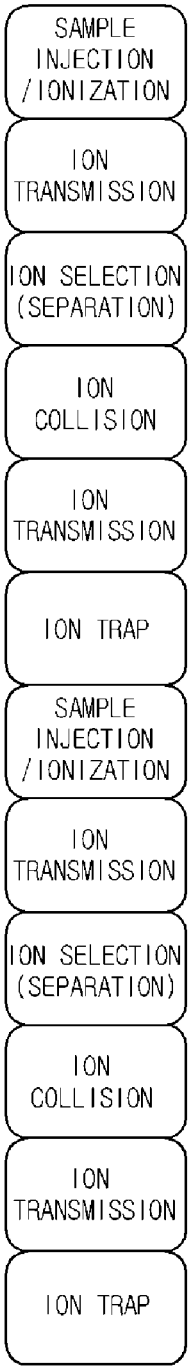
FIG. 3 shows a sequence of controlling respective blocks in a control program according to a related art.
Figure 4A:
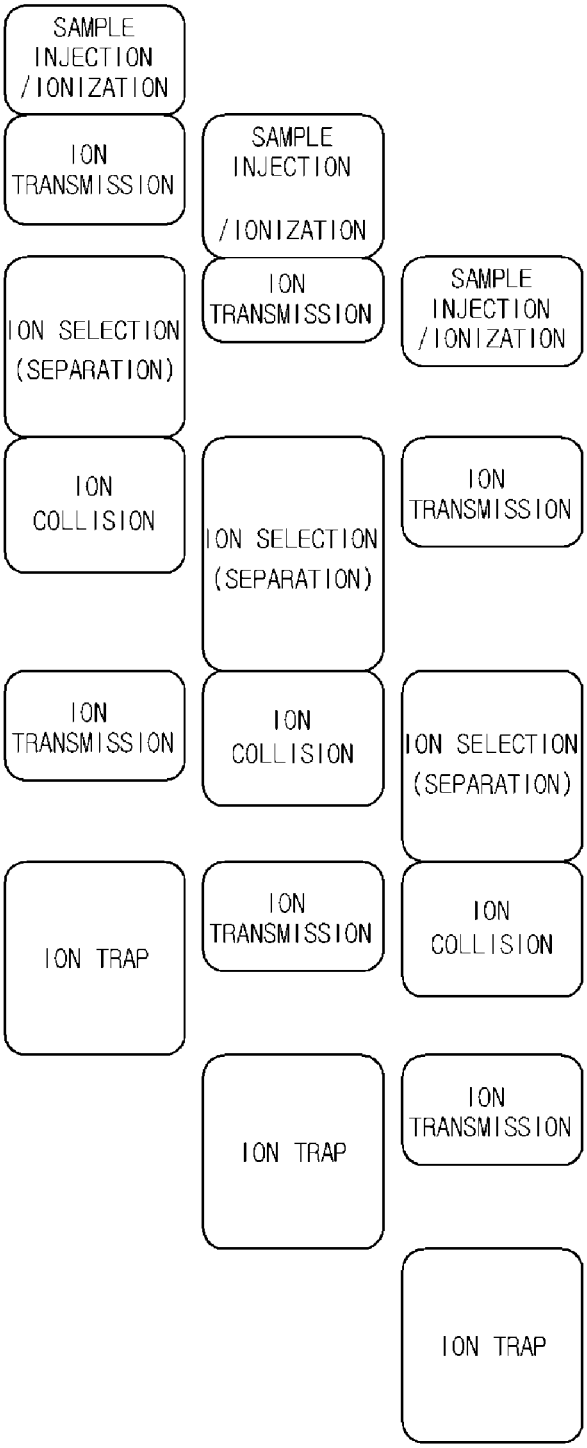
FIGS. 4*a* and 4*b* are views for explaining a way to use hardware resources through a pipeline control method according to a related art.
Figure 4B:
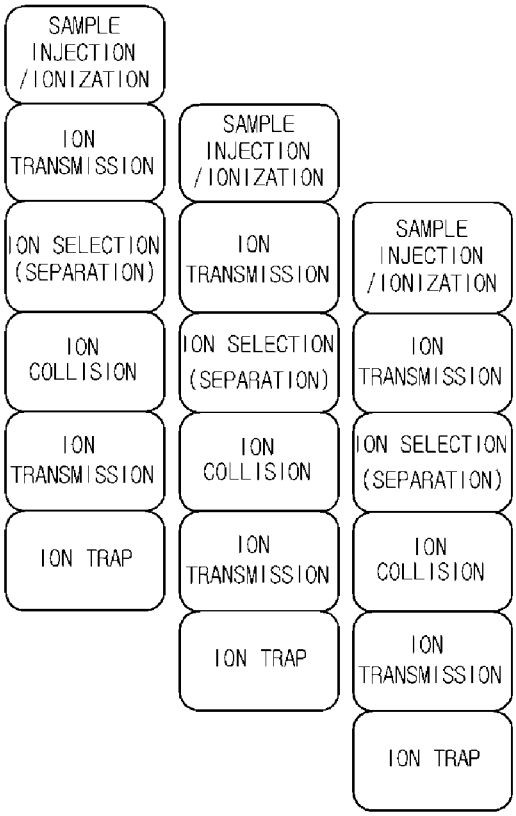

An apparatus for controlling a pipeline-type ion cyclotron resonance mass spectrometer in accordance with an exemplary embodiment of the present invention will be described below in detail with reference to FIGS. 5 to 7.

Here, like elements in the background art are designated by like reference numerals, and thus, detailed descriptions thereof will not be repeated.

Figure 5:
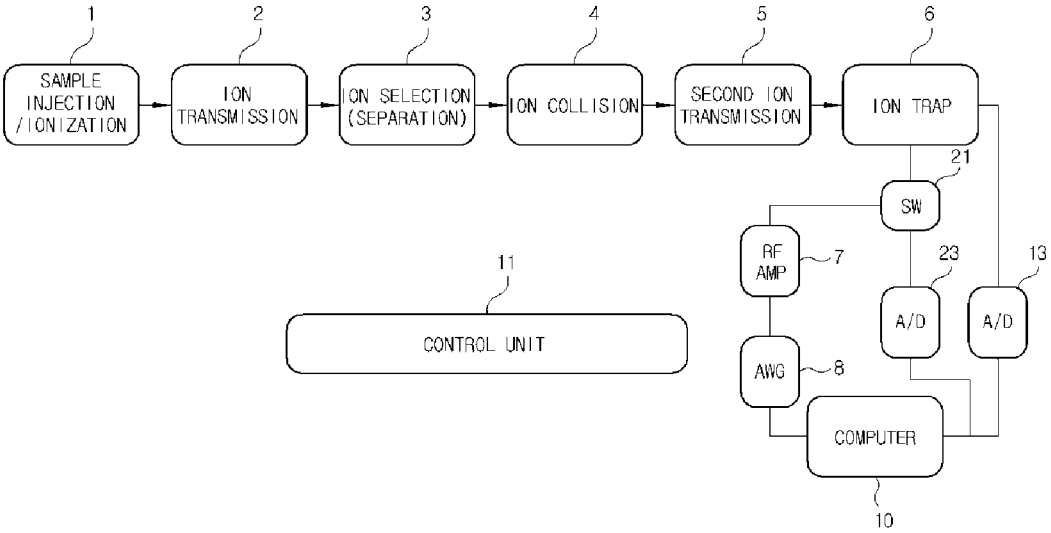
FIG. 5 is a control flowchart showing a control process of a pipeline-type ion cyclotron resonance mass spectrometer in accordance with an exemplary embodiment of the present invention.
Figure 6:
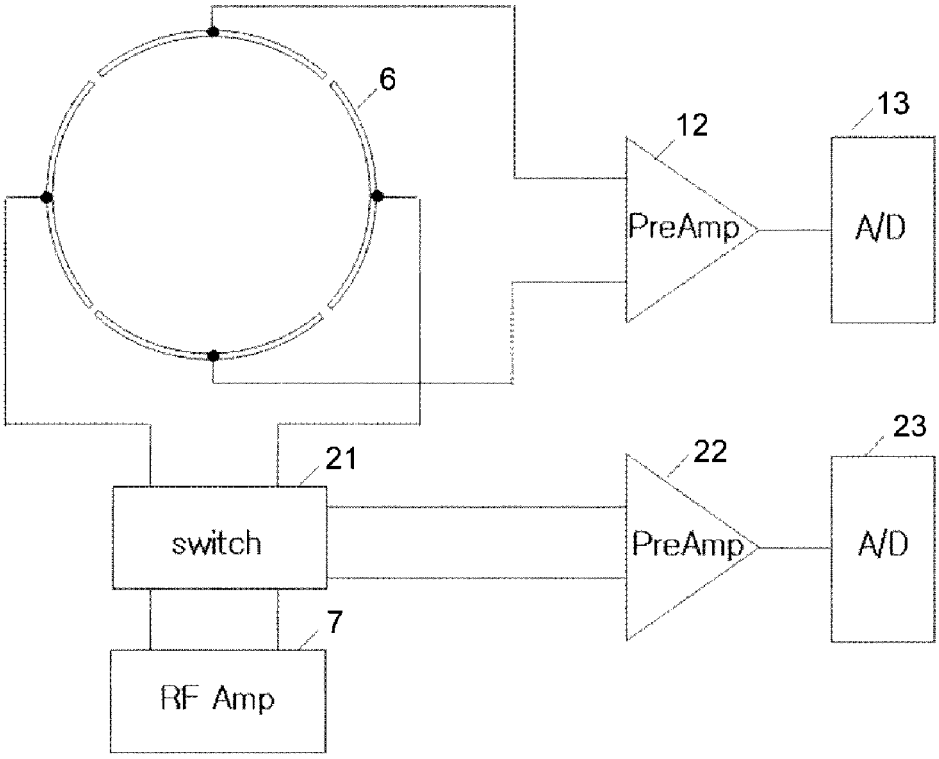
FIG. 6 is a detailed block diagram of an ion trap unit of an apparatus for controlling a pipeline-type ion cyclotron resonance mass spectrometer in accordance with an exemplary embodiment of the present invention.

FIG. 5 is a control block diagram showing a control process of a pipeline-type ion cyclotron resonance mass spectrometer in accordance with an exemplary embodiment of the present invention, and FIG. 6 is a detailed block diagram of an ion trap of an apparatus for controlling a pipeline-type ion cyclotron resonance mass spectrometer in accordance with an exemplary embodiment of the present invention.

Here, the ion trap unit is configured such that an excitation signal applied to an ion trap 6 is applied to the ion trap 6 via a high frequency amplification unit 7 and a switching unit 21.

That is, when a high frequency-amplified signal is applied to an excitation electrode of the ion trap 6, the high frequency signal amplified by the high frequency amplification unit 7 of FIG. 6 is applied to the excitation electrode of the ion trap 6 via the switching unit 21 to control directionality.

The signal applied to the excitation electrode of the ion trap 6 excites ions in the ion trap 6 to cause ion movement, and the ion movement passes through a first pre-amplifier 12 via the electrode from a detection electrode, and then, it is digitalized through a first digitizer 13 as a digital signal to be transmitted to the computer 10.

Here, the signal is also detected through the excitation electrode of the ion trap 6 to be amplified at a second pre-amplifier 22 via the switching unit 21, and then, processed as a digital signal through a second digitizer 23 to be transmitted to the computer 10.

Reviewing an operation of the switching unit 21 in detail, first, a waveform is generated from an arbitrary waveform generating unit 8 by an output signal of the computer 10, and amplified by the high frequency amplification unit 7 to be applied to the excitation electrode of the ion trap 6 via the switching unit 21.

Here, when the high frequency signal is applied from the high frequency amplification unit 7 to the ion trap 6, the high frequency signal has directionality to pass through the excitation electrode only. In addition, after the high frequency signal is applied, as the switching unit 21 is operated to change signal direction while the high to frequency amplification unit 7 is OFF, the signal detected by ion movement in the ion trap 6 passes through the switching unit 21 to be applied to the second pre-amplifier 22 and the second digitizer 23 to have a signal flow.

A control unit 11 performs functions of operating a sample injection/ionization unit 1 to ionize and discharge an injected sample, continuously operating a first ion transmission unit 2 to transmit the ions discharged from the sample injection/ionization unit 1, continuously operating an ion selection (separation) unit 3 to select or separate and discharge the transmitted ions according to a specific purpose, continuously operating an ion collision unit 4 to collide the ions selected or separated by the ion selection (separation) unit 3 with a collision gas to divide the ions into smaller sizes and discharge the divided ions, continuously operating a second ion transmission unit 5 to transmit the collided ions, continuously operating the ion trap unit 6 to collect the transmitted collided ions into the ion trap and then detect an electrical signal representing the mass of ions satisfying a specific purpose, transmitting the electrical signal detected by the ion trap unit 6 to the computer 10 equipped with a mass measurement and analysis program, and sequentially controlling the respective units to a repeat number N determined for the experiment.

Figure 7:
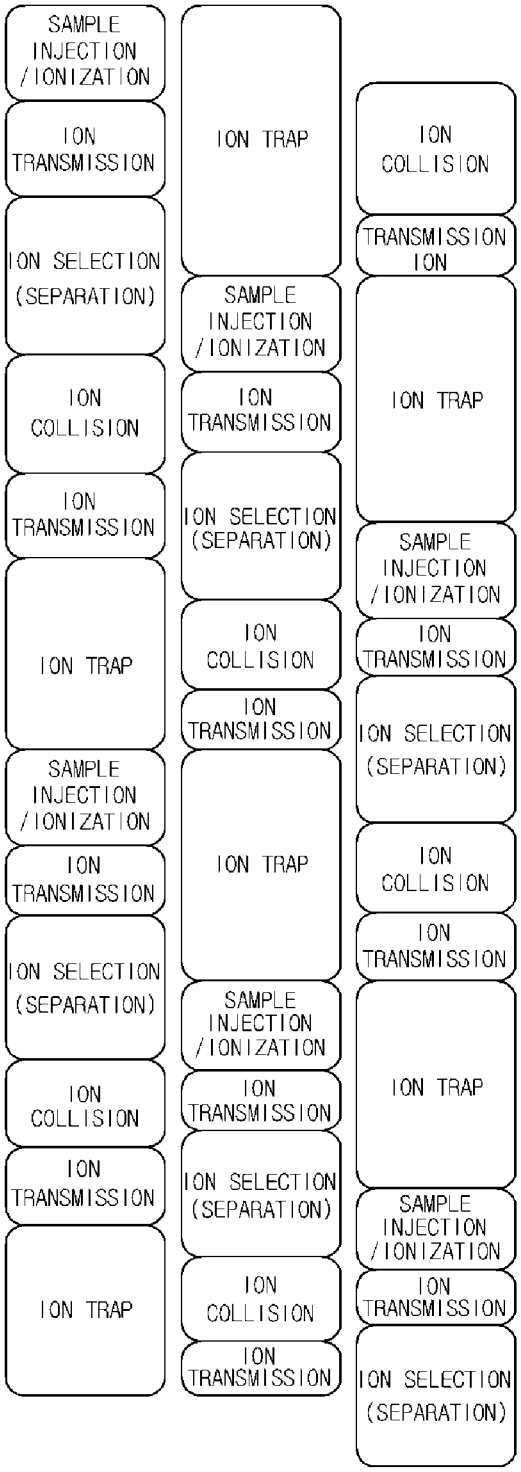
FIG. 7 is a block diagram showing a control procedure of the pipeline-type ion cyclotron resonance mass spectrometer through a software control method in accordance with an exemplary embodiment of the present invention.

FIG. 7 is a block diagram showing a control procedure of the pipeline-type ion cyclotron resonance mass spectrometer by a software control method in accordance with an exemplary embodiment of the present invention.

As shown, the hardware resources can be independently controlled with no overlap therebetween and are constituted by elements with no control element, which is fed back.

Since the control procedure is configured not to overlap blocks, in which a signal to is excited and a signal is detected in the ion trap, and in each control procedure, the control program is configured to allow independency of each control procedure, time loss can be reduced.

That is, since the switching unit and the two digitizers 13 and 23 can be simultaneously used in the ion trap unit, sensitivity of the sample to be inspected when an ion signal is to be detected can be improved.

In addition, when a long signal process time is needed, since the switching unit 21 is controlled so that the first and second digitizers 13 and 23 are parallelly controlled when two signal processing regions of the digitizers 13 and 23 are alternately used, the number of measurements can be increased when the experiment is performed for the same time.

As described above, the embodiment showing the control procedures of the pipeline-type ion cyclotron resonance mass spectrometer and configuration of the signal detection unit in accordance with the present invention has been described.

The foregoing description concerns an exemplary embodiment of the invention, is intended to be illustrative, and should not be construed as limiting the invention. The present teachings can be readily applied to other types of devices and apparatuses. Many alternatives, modifications, and variations within the scope and spirit of the present invention will be apparent to those skilled in the art.

What is claimed is:

1. A method of controlling a pipeline-type ion cyclotron resonance mass spectrometer including a sample injection/ionization unit, a first ion transmission unit connected to the sample injection/ionization unit, an ion selection unit connected to the first ion transmission unit, an ion collision unit connected to the ion selection unit, a second ion transmission unit connected to the ion collision unit, an ion trap connected to the second ion transmission unit and collecting ions to detect an electrical signal representing the mass of the ions, two excitation electrodes exciting the ions in the ion trap and detecting the electrical signal, two detection electrodes detecting the electrical signal, an arbitrary waveform generating unit controlled by a computer and generating an arbitrary waveform, a high frequency amplification unit connected to arbitrary waveform generating unit, a switching unit connected between the high frequency amplification unit and the excitation electrodes of the ion trap, a first pre-amplifier connected to the detection electrodes of the ion trap, a first digitizer connected to the first pre-amplifier, a second pre-amplifier connected to the switching unit, a second digitizer connected to the second pre-amplifier, and a control unit sequentially controlling the respective units for measuring samples, the method comprising:

a) ionizing and discharging sequentially injected samples by the sample injection/ionization unit;

b) transmitting ions discharged from the sample injection/ionization unit to the ion selection unit by the first ion transmission unit;

c) selecting or separating, and discharging the transmitted ions by the ion selection unit;

d) colliding the ions selected or separated by the ion selection unit with a collision gas to divide the ions into smaller sizes and discharging the divided ions by the ion collision unit;

e) transmitting the ions to the ion trap by the second ion transmission unit;

f) collecting the transmitted ions by the ion trap;

g) switching the switching unit to connect the high frequency amplification unit with the excitation electrodes in order to transmit the arbitrary waveform from the high frequency amplification unit to the excitation electrodes when the arbitrary waveform is input from the high frequency amplification unit to the switching unit;

h) detecting a first electrical signal representing the mass of the ions of a first sample only by the detection electrodes, transmitting the first electrical signal to the first pre-amplifier, digitalizing the first electrical signal by the first digitizer and transmitting the digitalized first electrical signal to the computer, for signal processing;

i) switching the switching unit to connect the excitation electrodes to the second pre-amplifier in order to detect a second electrical signal representing the mass of the ions of a second sample alternately with the detection electrodes, when the arbitrary waveform is not input from the high frequency amplification unit to the switching unit; and j) detecting the second electrical signal representing the mass of the ions of the second sample only by the excitation electrodes, transmitting the second electrical signal to the switching unit, digitalizing the second electrical signal by the second digitizer and transmitting the digitalized second electrical signal to the computer, for signal processing;

wherein the step h) and the steps i) through j) are processed alternately such that the detection electrodes and the excitation electrodes alternately detect said respective electrical signals of the samples to be measured sequentially, and, before completion of the signal processing of the first electrical signal for the first sample, the second electrical signal for the second sample is detected, thereby reducing a time delay due to the signal processing in said pre-amplifiers, said digitizers and the computer and reducing a total processing time for measuring the samples.

* * * * *